US006708529B2

(12) United States Patent
Yamazaki et al.

(10) Patent No.: US 6,708,529 B2
(45) Date of Patent: Mar. 23, 2004

(54) UNDERGARMENT

(75) Inventors: Hiroshi Yamazaki, Ibaraki (JP); Masataka Ikeda, Takatsuki (JP)

(73) Assignee: Asahi Kasei Kabushiki Kaisha, Osaka (JP)

( * ) Notice: Subject to any disclaimer, the term of this patent is extended or adjusted under 35 U.S.C. 154(b) by 0 days.

(21) Appl. No.: 10/099,952

(22) Filed: Mar. 19, 2002

(65) Prior Publication Data

US 2003/0056553 A1 Mar. 27, 2003

(30) Foreign Application Priority Data

Mar. 19, 2001 (JP) ..... 2001-078844

(51) Int. Cl.[7] ..... A41B 9/00
(52) U.S. Cl. ..... 66/171; 66/177
(58) Field of Search ..... 66/169 R, 170, 66/171, 177, 202, 176; 442/311, 308, 310

(56) References Cited

U.S. PATENT DOCUMENTS 3,584,074 A * 6/1971 Shima et al. ..... 525/425
3,671,379 A 6/1972 Evans et al. ..... 161/173
3,971,234 A * 7/1976 Taylor ..... 66/200
4,229,954 A * 10/1980 Blore ..... 66/196
4,748,078 A * 5/1988 Doi et al. ..... 442/312
6,383,632 B2 * 5/2002 Howell et al. ..... 428/364

FOREIGN PATENT DOCUMENTS

| | | | |
|---|---|---|---|
| JP | 11001835 | A | 1/1999 |
| JP | 11237799 | A | 8/1999 |
| JP | 2000314055 | A | 11/2000 |
| JP | 2001064853 | A | 3/2001 |
| JP | 2001205165 | A | 10/2001 |
| WO | WO 01/23654 | A1 | 4/2001 |

* cited by examiner

*Primary Examiner*—Danny Worrell
(74) *Attorney, Agent, or Firm*—Finnegan, Henderson, Farabow, Garrett & Dunner, L.L.P.

(57) ABSTRACT

An undergarment formed from a tubular mixed knitted fabric that comprises a poly(trimethylene terephthalate) fiber crimped yarn and a short fiber, a blending ratio of the crimped yarn is 15 to 60% by weight, a blending ratio of the short fiber is 30 to 85% by weight, and the tubular mixed knitted fabric has a course number of from 30 to 70 courses/2.54 cm and a wale number of from 30 to 70 wales/2.54 cm.

9 Claims, No Drawings

UNDERGARMENT

TECHNICAL FIELD

The present invention relates to an undergarment formed from a tubular knitted fabric containing a poly(trimethylene terephthalate) fiber crimped yarn.

BACKGROUND ART

As lifestyles change, an undergarment that is not tight while giving a suitable fitting feeling to the wearer and having adaptability to the body movement, and, in addition to that, that is flexible and excellent in stretchability and elongation recovery has been desired in recent years.

For undergarments having stretchability, those prepared from a knitted fabric in which an elastic fiber is blended by mixed knitting, or a similar procedure, have been commercialized. However, an undergarment in which an elastic fiber such as a polyurethane fiber is blended makes the wearer feel confined because it is thick and gives a tight feeling. Moreover, because an elastic fiber itself is degraded when it is exposed to light, chlorine, etc., the undergarment has the problem that it loses adaptability to the body movement when it is subjected to repeated washing that causes breakage of the elastic fiber.

Stretchable undergarments the tightening feeling of which is suppressed have been commercialized by using a polyester fiber crimped yarn having a poly(ethylene terephthalate) as its principal component. However, such undergarments lack stretchability in the warp direction although they have stretchability to a certain degree in the weft direction. As a result, the fabric does not adequately follow the elongation in portions such as an elbow portion and a knee portion that are required to elongate sufficiently in the warp direction. The wearers therefore feel confined, and the undergarments have a stiff feel. Moreover, because the poly(ethylene terephthalate) fiber shows a low elongation recovery, the undergarments have the disadvantage that the shape stability is poor, for example, bubbling (wrinkle) is formed in the necks and bottoms of the undergarments when the undergarments are repeatedly washed and worn.

There are undergarments for which a nylon fiber crimped yarn having a relatively flexible feeling is used. However, they give a poor wear feeling because they lack stretchability in the warp direction similarly to the undergarments of a polyester fiber. Moreover, the undergarments have the following disadvantages. They not only show poor shape stability when repeatedly washed and worn, but also yellow when heated, are contacted with $NO_x$ gas or are stored in a corrugated cardboard box over a long period of time.

In contrast to the nylon fiber, the poly(trimethylene terephthalate) fiber shows a low Young's modulus, an excellent elongation recovery, substantially no embrittlement caused by light and chlorine, and an excellent resistance to yellowing. The fiber therefore can be expected to give a fabric appropriate to undergarments.

Japanese Unexamined Patent Publication (Kokai) No. 11-12902 describes an invention related to a mixed knitted fabric prepared by mixed knitting a poly(trimethylene terephthalate) fiber yarn and a cellulose-based fiber yarn. The invention described in the patent publication is one that is aimed at obtaining a knitted fabric that has a feeling specific to cellulose-based fiber filaments and that produces no streaks and shade bars. There is no description in the invention related to designing a knitted fabric when the tubular knitted fabric is to be used as undergarments. Moreover, the knitted fabric disclosed in the patent publication substantially shows no stretchability, and cannot be said to be excellent in comfort and shape stability, after washing, when used for undergarments.

Japanese Unexamined Patent Publication (Kokai) No. 2001-64853 describes an invention related a knitted fabric containing a poly(trimethylene terephthalate) fiber yarn. The invention described in the patent publication is one aimed at obtaining a knitted fabric excellent in instantaneous recovery subsequent to dry cleaning. There is no description of the use of the tubular knitted fabric for undergarments. Moreover, the invention defines the stretchability in one direction alone, namely, in the warp or weft direction. Furthermore, although the knitted fabric disclosed in the patent publication has suitable stretchability and an instantaneous recovery subsequent to dry cleaning in one of the two directions alone, the knitted fabric, used for undergarments that are required to have suitable stretchability in both the warp and weft directions, cannot be said to be excellent in a comfortable feeling to the wearer.

DISCLOSURE OF THE INVENTION

An object of the present invention is to provide an undergarment formed from a tubular knitted fabric having a poly(trimethylene terephthalate) fiber crimped yarn. The undergarment of the invention has a flexible feeling, shows excellent stretchability and elongation recovery in both the warp and weft directions, and is excellent in durability and/or comfortable feeling to the wearer.

As a result of intensively carrying out investigations to attain the above objects, the present inventors have achieved the present invention.

That is, the present invention is as explained below.

1. An undergarment formed from a tubular knitted fabric that comprises a poly(trimethylene terephthalate) fiber crimped yarn in a blending ratio of 15% by weight or more, the tubular knitted fabric having a course number of from 30 to 70 courses/2.54 cm and a wale number of from 30 to 70 wales/2.54 cm.

2. The undergarment according to 1, wherein the poly (trimethylene terephthalate) fiber crimped yarn is composed of a false-twisted yarn.

3. The undergarment according to 1 or 2, wherein the poly(trimethylene terephthalate) fiber crimped yarn is a latently crimpable polyester fiber comprising a plurality of polyester components, and at least one of the components is a poly(trimethylene terephthalate).

4. The undergarment according to 3, wherein the latently crimpable polyester fiber satisfies the following conditions (a) to (c):

(a) an initial tensile resistance of from 10 to 30 cN/dtex;

(b) a stretch elongation of crimp of from 10 to 100% and a stretch modulus of crimp of from 80 to 100% after development of latent crimping; and (c) a thermal shrinkage stress at 100° C. of from 0.1 to 0.5 cN/dtex.

5. The undergarment according to any one of 1 to 4, wherein the tubular knitted fabric is formed from a poly (trimethylene terephthalate) fiber crimped yarn and a short fiber.

6. The undergarment according to 5, wherein the short fiber is at least one fiber selected from the group consisting of a cellulose-based fiber, an acrylic fiber and an animal fiber.

7. The undergarment according to any one of 1 to 6, wherein the blending ratio of a poly(trimethylene terephthalate) fiber crimped yarn is from 20 to 60% by weight.

8. The undergarment according to any one of 1 to 7, wherein the (course number)/(wale number) ratio of the tubular knitted fabric is from 0.5 to 1.5.

9. The undergarment according to any one of 1 to 8, wherein the {stretch ratio in the warp (course) direction}/{stretch ratio in the weft (wale) direction} ratio of the tubular knitted fabric is from 0.2 to 1.2.

10. The undergarment according to any one of 1 to 9, wherein the stress at 30% elongation of the tubular knitted fabric is from 0.2 to 4.9 N/cm in the warp (course) direction.

11. The undergarment according to any one of 1 to 10, wherein the ratio of dimensional change of the tubular knitted fabric is 10% or less in the warp (course) direction after repeating 30% elongation in the warp (course) direction of the knitted fabric 10,000 times.

The present invention will be explained below in detail.

In the present invention, undergarments designate clothing directly contacted with the skin of the upper half or lower half of the body, and function as underwear. Examples of the undergarments include shirts, body wear, tank tops, camisoles, slips, pants, shorts, briefs, trunks and underpants. However, the undergarments are not always worn in such a manner that other persons cannot see them, but they include clothing that are worn in such a manner that other persons can see them.

In the present invention, the poly(trimethylene terephthalate) fiber designates a fiber of a polyester having trimethylene terephthalate units as principal repeating units, and contains trimethylene terephthalate units in an amount of 50% by mole or more, preferably 70% by mole or more, more preferably 80% by mole or more, most preferably 90% by mole or more. Accordingly, the poly(trimethylene terephthalate) includes a poly(trimethylene terephthalate) containing as third components other acid components and/or glycol components in a total amount of 50% by mole or less, preferably 30% by mole or less, more preferably 20% by mole or less, most preferably 10% by mole or less.

A poly(trimethylene terephthalate) is synthesized by combining terephthalic acid or a functional derivative thereof, and trimethylene glycol or a functional derivative of trimethylene glycol under suitable reaction conditions in the presence of a catalyst. In the course of the synthesis, a suitable one, or two or more, third components may be added to give a copolymerized polyester. Alternatively, a poly(trimethylene terephthalate), and a polyester other than a poly(trimethylene terephthalate) such as a poly(ethylene terephthalate) or nylon may be blended or composite spun (sheath-core, side-by-side, etc.).

Examples of the third component to be added include aliphatic dicarboxylic acids such as oxalic acid and adipic acid, alicyclic dicarboxylic acids such as cyclohexanedicarboxylic acid, aromatic dicarboxylic acids such as isophthalic acid and sodium sulfoisophthalic acid, aliphatic glycols such as ethylene glycol, 1,2-propylene glycol and tetramethylene glycol, alicyclic glycols such as cyclohexanedimethanol, aliphatic glycols containing an aromatic group such as 1,4-bis(β-hydroxyethoxy)benzene, polyether glycols such as poly(ethylene glycol) and poly(propylene glycol), aliphatic oxycarboxylic acids such as ω-oxycaproic acid, and aromatic oxycarboxylic acids such as p-oxybenzoic acid.

Moreover, a compound (such as benzoic acid or glycerin) having one or three or more ester-forming functional groups may also be used as long as the resultant polymer is substantially linear.

Furthermore, the poly(trimethylene terephthalate) fiber used in the present invention may contain delustering agents such as titanium dioxide, stabilizing agents such as phosphoric acid, ultraviolet ray absorbers such as a hydroxybenzophenone derivative, nucleating agents such as talc, lubricants such as Aerosil, antioxidants such as a hindered phenol derivative, flame retardants, antistatic agents, pigments, fluorescent brighteners, infrared ray absorbers, defoaming agents, and the like.

There is no specific limitation on the spinning method of the poly(trimethylene terephthalate) fiber used in the present invention, and any of the methods such as mentioned below may be adopted: a method comprising spinning at a winding rate of about 1,500 m/min to give an undrawn yarn, and drawing and twisting the yarn by a draw ratio of from about 2 to 3.5; a direct drawing method (spin draw method) in which a spinning step and a drawing and twisting step are directly connected; and a high speed spinning method (spin take-up method) comprising winding at a rate of 5,000 m/min or more.

Although the shape of the poly(trimethylene terephthalate) fiber may be either a filament yarn or a short yarn, a filament yarn is preferred. The yarn may be uniform, or thick and thin in the longitudinal direction. Moreover, the cross section of the yarn may be round-shaped, triangle-shaped, L-shaped, T-shaped, Y-shaped, W-shaped, eight leaf-shaped, flat (a flatness of from about 1.3 to 4, e.g., W-shaped, I-shaped, boomerang-shaped, wave-shaped, skewered dumpling-shaped, cocoon-shaped, rectangular parallelepiped-shaped, etc.), polygonal (e.g., dog bone-shaped), multi-leaf-shaped, hollow or indefinitely shaped.

Furthermore, the yarn is preferably in a shape of a multifilaments yarn (including an extremely thin yarn), or it may be in a shape of a twisted yarn (soft-twisted or hard-twisted).

The properties of the poly(trimethylene terephthalate) fiber in the present invention will be explained below. The fiber has a strength of preferably from 2 to 5 cN/dtex, more preferably from 2.5 to 4.5 cN/dtex, most preferably from 3 to 4.5 cN/dtex. The fiber has an elongation of preferably from 30 to 60%, more preferably from 35 to 55%, most preferably from 40 to 55%. The fiber has an elastic modulus of preferably 30 cN/dtex or less, more preferably from 10 to 30 cN/dtex, still more preferably from 12 to 28 cN/dtex, most preferably from 15 to 25 cN/dtex. The fiber has an elastic recovery at 20% elongation of preferably 60% or more, more preferably 70% or more, still more preferably 80% or more, most preferably 85% or more.

The fiber has a total size of preferably from 20 to 550 dtex, more preferably from 30 to 220 dtex. Moreover, the fiber preferably has a single filament size of from 0.1 to 12 dtex, particularly preferably from 0.5 to 5 dtex in view of the soft feeling.

The undergarment of the present invention is formed from a tubular knitted fabric having a poly(trimethylene terephthalate) fiber crimped yarn.

Examples of the poly(trimethylene terephthalate) fiber crimped yarn include a crimped yarn prepared by subjecting a poly(trimethylene terephthalate) fiber to crimping such as false twisting, stuffing-box crimping, knit-deknit texturing, and fluid-jet texturing, and a latently crimpable polyester fiber yarn formed from a plurality of polyester components at least one of which is a poly(trimethylene terephthalate).

In the present invention, the poly(trimethylene terephthalate) fiber crimped yarn may optionally be a composite false-twisted yarn prepared from poly(trimethylene terephthalate) fiber crimped yarns, or a poly(trimethylene terephthalate) fiber crimped yarn and another fiber yarn by a known composite false-twisting procedure such as simultaneous false twisting, phase-differenced false twisting and elongation-differenced false twisting. Moreover, the poly (trimethylene terephthalate) fiber crimped yarn may also be a composite yarn obtained by subjecting a poly(trimethylene terephthalate) fiber crimped yarn and a raw yarn (drawn yarn), a textured yarn, a spun yarn, or the like of another fiber yarn to a procedure such as interlaced mingling, fluid-jet texturing and a twisted combination.

Furthermore, the above poly(trimethylene terephthalate) fiber crimped yarn, composite false-twisted yarn and composite yarn may further be twisted.

In the present invention, the poly(trimethylene terephthalate) fiber crimped yarn has a crimp elongation of preferably 5% or more, more preferably 10% or more, most preferably 50% or more. When the crimp elongation is 5% or more, the knitted fabric shows a sufficient stretch ratio particularly in the warp direction. The undergarment obtained from the knitted fabric gives an excellent comfortable feeling to the wearer. In addition, the crimp elongation is determined by the measurement method to be described later.

In the present invention, of poly(trimethylene terephthalate) fiber crimped yarns, a poly(trimethylene terephthalate) false-twisted yarn that can readily have a high crimp elongation is preferred.

There is no specific limitation on the method of false twisting. Generally used false twisting such as false twisting of pin type, friction type, nip belt type, or air twisting type can be employed. Moreover, the false twisting may be either one heater false twisting, or two heater false twisting. Furthermore, it may also be drawing and false twisting of POY.

The false-twisting heater temperature can optionally be set as long as the object of the present invention can be achieved. In general, the yarn temperature immediately after the outlet of a first heater is preferably from 100° C. or more to 200° C. or less, more preferably from 120° C. or more to 180° C. or less, most preferably from 130° C. or more to 170° C. or less.

Moreover, the yarn may optionally be heat set with a second heater to give a two-heater false-twisted yarn. The second heater temperature is preferably from 100° C. or more to 210° C. or less, more preferably from YT−30° C. or higher to YT+50° C. or lower (YT: yarn temperature immediately after the outlet of the first heater). The overfeed ratio within the second heater (second overfeed ratio) is preferably from +3% or more to +30% or less.

The number of false twisting T is in a range usually used in the false-twisting step of the poly(ethylene terephthalate) fiber, and can be calculated from the following formula:

$$T(T/m)=K/\{\text{size } (dtex) \text{ of false twisted yarn}\}^{0.5}$$

wherein K is a coefficient of false-twisting number. K is preferably from 17,600 to 29,500, and the preferred number of false twisting T is determined by the size of the false-twisted yarn.

The two-heater false-twisted yarn of a poly(trimethylene terephthalate) fiber shows somewhat lowered crimpability and resultant slightly lowered bulkiness in comparison with the one-heater false-twisted yarn. However, when an undergarment is prepared from the false twisted yarn, the undergarment can maintain practically sufficient bulkiness. Moreover, because the fabric shows improved surface smoothness while the harsh and bulky feelings disappear, and can adequately display a soft feeling specific to a poly(trimethylene terephthalate) fiber, the two-heater false-twisted yarn is appropriate to an undergarment.

A preferred example of the poly(trimethylene terephthalate) fiber crimped yarn is a crimped yarn of a latently crimpable polyester fiber formed from a plurality of polyester components at least one of which is a poly (trimethylene terephthalate).

The latently crimpable polyester fiber is a fiber formed from at least two polyester components (specifically, the at least two components being bonded in a side-by-side manner or in an eccentric core-sheath manner), and crimping is developed by heat treatment. There is no specific restriction on the compositing ratio of the two polyester components (in general, the compositing ratio in terms of weight ratio being often from 70/30 to 30/70), and the shape (linear or curved) of the bonded surface in the cross-section of the single filament.

A specific example of the fiber is one that has a poly (trimethylene terephthalate) as one component as disclosed in Japanese Unexamined Patent Publication (Kokai) No. 2001-40537. The fiber disclosed in the patent publication is a composite fiber in which two types of polyesters are bonded in a side-by-side manner or in an eccentric core-sheath manner. For a composite fiber of a side-by-side type, the melt viscosity ratio of the two types of polyesters is preferably from 1.00 to 2.00. Moreover, for a composite fiber of an eccentric core-sheath type, the ratio of an alkali reduction rate of a sheath polymer to an alkali reduction rate of a core polymer is preferably 3 or more.

Preferred examples of the combination of polymers include: a combination of a poly(trimethylene terephthalate) (that is a polyester having terephthalic acid as a principal dicarboxylic acid component and 1,3-propanediol as a principal glycol component, that may be copolymerized with a glycol such as ethylene glycol and butanediol, a dicarboxylic acid such as isophthalic acid and 2,6-naphthalenedicarboxylic acid, and the like, and that may contain another polymer and additives such as a delustering agent, a flame retardant, an antistatic agent and a pigment) and a poly(ethylene terephthalate) (that is a polyester having terephthalic acid as a principal dicarboxylic acid component and ethylene glycol as a principal glycol component, that may be copolymerized with a glycol such as butanediol, a dicarboxylic acid such as isophthalic acid and 2,6-naphthalenedicarboxylic acid, and the like, and that may contain another polymer and additives such as a delustering agent, a flame retardant, an antistatic agent and a pigment); and a combination of a poly(trimethylene terephthalate) and a poly(butylene terephthalate) (that is a polyester having terephthalic acid as a principal dicarboxylic acid component and 1,4-butanediol as a principal glycol component, that may be copolymerized with a glycol such as ethylene glycol, a dicarboxylic acid such as isophthalic acid and 2,6-naphthalenedicarboxylic acid, and the like, and that may contain another polymer and additives such as a delustering agent, a flame retardant, an antistatic agent and a pigment). It is particularly preferred that a poly(trimethylene terephthalate) be arranged inside the crimp.

As explained above, at least one of the polyester components forming the latently crimpable polyester fiber in the present invention is preferably a poly(trimethylene terephthalate). Specific examples are disclosed in Japanese Examined Patent Publication (Kokoku) No. 43-19108, Japanese Unexamined Patent Publication (Kokai) No. 11-189923, Japanese Unexamined Patent Publication (Kokai) No. 2000-239927, Japanese Unexamined Patent Publication (Kokai) No. 2000-256918, Japanese Unexamined Patent Publication (Kokai) No. 2000-328382, Japanese Unexamined Patent Publication (Kokai) No. 2001-81640, and the like in addition to Japanese Unexamined Patent Publication (Kokai) No. 2001-40537 mentioned above.

For example, the following latently crimpable poly (trimethylene terephthalate) fiber yarns are disclosed: a yarn prepared by parallelly arranging a poly(trimethylene terephthalate) as a first component and a polyester such as a poly(trimethylene terephthalate), a poly(ethylene terephthalate) or a poly(butylene terephthalate) as a second component, and compositely spinning the first and second components in a side-by-side manner; or a yarn prepared by eccentrically arranging the first and second components mentioned above and compositely spinning in an eccentric sheath-core manner. In particular, a combination of a poly (trimethylene terephthalate) and a copolymerized poly (trimethylene terephthalate), and a combination of two types of poly(trimethylene terephthalate) differing from each other in intrinsic viscosity are preferred.

The latently crimpable polyester fiber of the present invention shows an initial tensile resistance of preferably from 10 to 30 cN/dtex, more preferably from 20 to 30 cN/dtex, still more preferably from 20 to 27 cN/dtex. In addition, the fiber is hardly produced when the initial tensile resistance is less than 10 cN/dtex.

When the latent crimpability of the above latently crimpable polyester fiber is developed, the fiber shows a stretch elongation of crimp of preferably from 10 to 100%, more preferably from 10 to 80%, still more preferably from 10 to 60%. Moreover, the fiber shows a stretch modulus of crimp of preferably from 80 to 100%, more preferably from 85 to 100%, still more preferably from 85 to 97%.

Furthermore, the thermal shrinkage stress at 100° C. is preferably from 0.1 to 0.5 cN/dtex, more preferably from 0.1 to 0.4 cN/dtex, still more preferably from 0.1 to 0.3 cN/dtex. The thermal shrinkage stress at 100° C. is an important condition for developing crimping of the tubular knitted fabric in the scouring and dyeing steps. That is, in order to overcome the constraining force of the knitted fabric and develop the crimping, the thermal shrinkage stress at 100° C. is preferably 0.1 cN/dtex or more.

The stretch elongation of crimp subsequent to boiling water treatment is preferably from 100 to 250%, more preferably from 150 to 250%, still more preferably from 180 to 250%. Moreover, the stretch modulus of crimp subsequent to boiling water treatment is preferably from 90 to 100%, more preferably from 95 to 100%.

One example of a latently crimpable polyester fiber having such properties is a composite fiber formed from a single filament that is prepared by mutually compositing two types of poly(trimethylene terephthalate) differing from each other in intrinsic viscosity in a side-by-side manner.

The difference in intrinsic viscosity of the two types of poly(trimethylene terephthalate) is preferably from 0.05 to 0.4 dl/g, more preferably from 0.1 to 0.35 dl/g, still more preferably from 0.15 to 0.35 dl/g. For example, when the intrinsic viscosity on the high viscosity side is selected from 0.7 to 1.3 dl/g, the intrinsic viscosity on the low viscosity side is selected preferably from 0.5 to 1.1 dl/g. In addition, the intrinsic viscosity on the low viscosity side is preferably 0.8 dl/g or more, more preferably from 0.85 to 1.0 dl/g, still more preferably from 0.9 to 1.0 dl/g.

Furthermore, the average intrinsic viscosity of the composite fiber is preferably from 0.7 to 1.2 dl/g, more preferably from 0.8 to 1.2 dl/g, still more preferably from 0.85 to 1.15 dl/g, most preferably from 0.9 to 1.1 dl/g.

In addition, the intrinsic viscosity value in the present invention designates not the intrinsic viscosity of a polymer to be used but that of a spun filament for reasons explained below. The poly(trimethylene terephthalate) tends to be thermally decomposed in comparison with a poly(ethylene terephthalate), and the like. As a result, even when a polymer having a high intrinsic viscosity is used, the intrinsic viscosity is lowered during spinning due to thermal decomposition. The resultant composite fiber does not maintain the initial difference in intrinsic viscosity of the polymers used therein.

In the present invention, any of the methods of spinning a latently crimpable polyester fiber disclosed in the above patent publications can be adopted. A preferred method is, for example, a method wherein an undrawn yarn is wound at a rate of 3,000 m/min or less, and drawing and twisting the undrawn yarn by a draw ratio of from 2 to 3.5. Moreover, the direct drawing method (spin draw method) in which a spinning step and a drawing and twisting step are directly connected, and a high speed spinning method (spin take-up method) in which the winding rate is 5,000 m/min or more may also be adopted.

Although the shape of the latently crimpable polyester fiber may be either a filaments yarn or a short yarn, a filaments yarn is preferred. The yarn may be uniform, or thick and thin in the longitudinal direction. Moreover, the cross section of the yarn may be round-shaped, triangle-shaped, L-shaped, T-shaped, Y-shaped, W-shaped, eight leaf-shaped, flat (a flatness of from about 1.3 to 4, e.g., W-shaped, I-shaped, boomerang-shaped, wave-shaped, skewered dumpling-shaped, cocoon-shaped, rectangular parallelepiped-shaped, etc.), polygonal (e.g., dog bone-shaped), multi-leaf-shaped, hollow or indefinitely shaped.

Furthermore, examples of the shape of the yarn include a multifilaments raw yarn (including an extremely thin yarn) having a filament size of preferably from 0.1 to 12 dtex, more preferably from 1 to 6 dtex, a soft or hard twisted yarn, a false-twisted yarn (including a drawn and false-twisted yarn of POY), an air-jet textured yarn, a stuffing-box crimped yarn and a knit-deknit textured yarn.

In particular, for the latently crimpable polyester fiber, the yarn itself has high stretchability to the same degree as a poly(trimethylene terephthalate) false-twisted yarn. A tubular knitted fabric having high stretchability is therefore obtained from the latently crimpable polyester fiber. Moreover, the yarn has no residual torque specific to a false-twisted yarn, and a skew occurrence is hardly formed during knitting; therefore the handling is easy. Furthermore, because the crimping step can be omitted, the production cost can be saved.

When the latently crimpable polyester fiber is further subjected to crimping such as false twisting, the stretchability of the tubular knitted fabric thus obtained can be further increased. As a method of crimping the latently crimpable polyester fiber, false twisting is preferred in view of obtaining a particularly high stretch elongation of crimp. The above false-twisting conditions for the poly(trimethylene terephthalate) fiber may be adopted. Moreover, the POY-DTY method may also be adopted.

The above poly(trimethylene terephthalate) fiber crimped yarn may further be blended with a cellulose-based fiber (natural cellulose fiber represented by cotton, hemp, etc., a regenerated cellulose fiber such as viscose rayon, cuprammonium rayon and polynosic rayon, a solvent-spun cellulose fiber such as Lyocell), an acrylic fiber, an animal fiber, (wool, alpaca, mohair, angora, camel, cashmere, etc.), silk, other fibers (including a filaments raw yarn and a short fiber of a poly(trimethylene terephthalate) fiber), and the like, by means such as staple fiber blending (CSIRO fil, etc.), filament mingling (a different shrinkage combined filaments yarn with a high shrinkage yarn, etc.), twisted combination, composite false twisting (elongation-differenced false twisting, etc.) and fluid-jet texturing with two feeds.

Examples of the method of blending mentioned above include: a method comprising double twisting a poly (trimethylene terephthalate) fiber crimped yarn and a cellulose-based fiber, an animal fiber or an acrylic fiber; a method comprising covering a poly(trimethylene terephthalate) fiber crimped yarn as a core with a cellulose-based fiber, an animal fiber or an acrylic fiber to effect twined around the core; and a method comprising doubling a poly(trimethylene terephthalate) fiber raw yarn, and a cellulose-based fiber or an acrylic fiber, and simultaneously false twisting the raw yarn and the fiber.

In particular, when a poly(trimethylene terephthalate) fiber raw yarn, and a cellulose-based fiber or the like are to be doubled and simultaneously false twisted, conducting interlacing of the raw yarn and the fiber in front of or behind the false-twisting zone using an interlacing nozzle is preferred because not only unification of them is advanced to improve the knittability, but also the undergarment prepared from the resultant yarn shows improved snagging.

In the above blending method, the following procedure is preferred because the fiber thus obtained shows improved stretchability. A poly(trimethylene terephthalate) fiber crimped yarn or raw yarn is composited with a cellulose-based fiber, an acrylic fiber, an animal fiber, or the like while the crimped or raw yarn is being elongated by from about 1 to 5%.

The blending ratio of the poly(trimethylene terephthalate) fiber crimped yarn in the tubular knitted fabric used in the present invention is 15% by weight or more, preferably from 20 to 60% by weight, more preferably from 30 to 50% by weight. When the blending ratio is 15% by weight or more, the tubular knitted fabric thus obtained shows a stretchability of 30% or more in the warp and weft directions. As a result, undergarments prepared therefrom show good adaptability to the body movement and give an excellent comfortable feeling to the wearer.

There is no specific limitation on the fiber that is other than the poly(trimethylene terephthalate) fiber crimped yarn and that forms the tubular knitted fabric used in the present invention. For example, the following may be used: the above cellulose-based fiber; an animal fiber; silk; acetate; synthetic fibers represented by a poly(ethylene terephthalate) fiber, a polyamide fiber and an acrylic fiber (including a modacrylic fiber).

In the present invention, use of various short fibers in combination is most preferred because the undergarments obtained show particularly excellent functions. Aggregation of fibers having a fiber length of from several to dozens of centimeters, preferably from 3 to 21 cm is preferred as short fibers. Such short fibers have a bulge of a yarn in comparison with filaments, and can contain much air within the fibers. The short fibers can therefore improve the heat retention the undergarment is required to have.

In addition, such an undergarment prepared from a tubular knitted fabric for which short fibers alone are used has the following problem: it shows a large frictional resistance at interlacing points of knit loops due to fine fluffs specific to short fibers, and hardly recovers (poor stretching-back properties) when elongated by wearing, and the like.

The present inventors have found that use of a tubular knitted fabric in the undergarment in which a poly (trimethylene terephthalate) fiber crimped yarn and a short fiber are composited greatly improves the stretching-back properties while the properties of the short fiber are being maintained.

In the present invention, the short fiber includes not only a natural fiber such as an animal fiber, cotton and hemp, but also a short fiber obtained by cutting with a tow breaking machine a filamentary yarn such as silk, regenerated cellulose fiber (such as cuprammonium rayon, viscose rayon and polynosic rayon), a solvent-spun cellulose fiber (such as Lyocell), and a synthetic fiber represented by acetate, polyester (such as poly(ethylene terephthalate)), polyamide and acrylic polymer. Moreover, the short fiber may also be a spun yarn prepared by spinning short fibers mentioned above and a spun yarn prepared by blending short fibers mentioned above.

In the present invention, it is particularly preferred to use at least one fiber selected from a cellulose-based fiber, an animal fiber and an acrylic fiber (including a modacrylic fiber) that are mentioned above, as a short fiber.

In the present invention, a tubular knitted fabric obtained by using a cellulose-based fiber as a short fiber is preferred for the following reasons: the fabric does not impair the feel and water absorption function that a cellulose-based fiber has, and the fabric shows added dimensional stability and stretchability; an undergarment prepared from the fabric shows a suitable bulge feel, and gives an excellent comfortable feeling to the wearer. In particular, when the wearer does not sweat, the undergarment shows excellent heat-retaining effects produced by air layers within the short fiber. Moreover, when the wearer sweats, the undergarment has high water absorption capability and gives excellent comfortable feeling to the wearer in comparison with an undergarment for which a filament yarn such as a regenerated cellulose-based filaments yarn is used.

Furthermore, use of ultra-long cotton or mercerized cotton for cotton is particularly preferred because the resultant undergarment shows improved smoothness and glossiness so that it has a high-grade feeling. Still furthermore, use of hollow cotton such as Spinair (trade name, manufactured by Kurabo Industries) is preferred because the resultant undergarment shows more increased heat-retaining effects.

In the present invention, a tubular knitted fabric for which an animal fiber and an acrylic fiber are used as short fibers is preferred for the following reasons: the fabric does not impair the feeling the animal fiber and acrylic fiber have, and the fabric shows added dimensional stability and stretchability; an undergarment prepared from the fabric shows a suitable bulge feeling and excellent heat retention. In particular, use of a drawn animal fiber for the animal fiber is preferred for reasons explained below. The resultant animal fiber is very soft and excellent in drapability, has the noble glossiness of animal fiber, and can make fine count yarn; therefore, the light gauged undergarment can be prepared therefrom. Specific examples of the drawn animal fiber include "CORRIELANA" (trade name, Kurabo Industries) and "OPTIM" (trade name, CSIRO Co. Ltd.).

In the present invention, the blending ratio of the at least one fiber selected from a cellulose-based short fiber, an animal fiber and an acrylic short fiber is, in view of the properties of each fiber and the achieved effect of the invention, preferably from 30 to 85% by weight, more preferably from 40 to 80% by weight, still more preferably from 50 to 70% by weight. When the blending ratio is in the above range, the properties of each fiber are sufficiently exploited, and the effects of the present invention are fully achieved.

The tubular knitted fabric used in the present invention has a course number and a wale number of from 30 to 70 courses/2.54 cm and from 30 to 70 wales/2.54 cm, respectively, preferably from 35 to 60 courses/2.54 cm and from 35 to 60 wales/2.54 cm, respectively. When the course number and wale number in the above range are combined with the blending ratio of the poly(trimethylene terephthalate) fiber crimped yarn, the tubular knitted fabric shows a stretch ratio of 30% or more in both the warp and weft directions, and an undergarment prepared therefrom shows excellent adaptability to the body movement. In addition, the course number and wale number are values determined in accordance with the measurement of density by JIS L-1018.

Even when a tubular knitted fabric has a course number and a wale number of less than 30 courses/2.54 cm and less than 30 wales/2.54 cm, respectively, the tubular knitted fabric may show a stretchability of 30% or more. However, the tubular knitted fabric shows a very poor recovery, and an undergarment prepared therefrom not only exhibits poor adaptability to the body movement but also has a poor outward appearance. Moreover, because the tubular knitted fabric becomes very coarse, an undergarment prepared therefrom has a heat-retaining function that insufficiently meets the requirement for protecting from the cold of winter, and the commodity value becomes extremely small.

On the other hand, when the course number and the wale number exceed 70 courses/2.54 cm and 70 wales/2.54 cm, respectively, the tubular knitted fabric shows a stretchability of less than 30%. As a result, the tubular knitted fabric shows poor adaptability to the body movement, and an undergarment prepared therefrom gives a poor comfortable feeling to the wearer.

When the poly(trimethylene terephthalate) fiber crimped yarn is conventionally knitted under the same general knitting conditions as those for a poly(ethylene terephthalate) fiber, or the like, the resultant gray fabric has a high density caused by knitting shrinkage. The knitting shrinkage is caused by the properties of the poly(trimethylene terephthalate) fiber itself that the poly(trimethylene terephthalate) fiber is excellent in elongation and elongation recovery under low stress. Moreover, when the gray fabric is dyed and finished, the poly(trimethylene terephthalate) fiber crimped yarn itself is heated during the above steps, and as a result crimping is further developed. Because the developing power of crimping is significant, the knitted fabric has a high density, a low stretchability and a stiff feeling. Accordingly, it is preferred in the present invention that a gray fabric be made coarser by from about 10 to 30% than the conventional knitting design for a common poly (ethylene terephthalate) fiber.

In order to obtain a course number and a wale number in specific ranges in the present invention, the following procedure may, for example, be conducted: a poly(trimethylene terephthalate) fiber crimped yarn is knitted with a double circular knitting machine of 20 GG to give a gray fabric, and the gray fabric is dye finished to give a tubular knitted fabric. However, because dye finishing the gray fabric greatly changes the course and wale numbers, the knitting conditions of the gray fabric must be determined while changes caused by dye finishing are taken into consideration in order to obtain a tubular knitted fabric having desired course and wale numbers.

In the present invention, the (course number)/(wale number) ratio of a tubular knitted fabric is preferably from 0.5 to 1.5, more preferably from 0.8 to 1.3. A knitted fabric having the ratio in the above range has a soft feeling, improved stretchability particularly in the warp (course) direction, and shows a good balance between a stretchability in the warp direction and a stretchability in the weft (wale) direction. As a result, an undergarment prepared therefrom becomes excellent in a comfortable feeling to the wearer. When the (course number)/(wale number) ratio is less than 0.5, the loop becomes longitudinally long, and an undergarment prepared therefrom tends to lose shape retention after washing or wearing. On the other hand, when the (course number)/(wale number) ratio exceeds 1.5, the undergarment shows a lowered stretchability; in particular, the undergarment tends to not only show a stretchability of less than 30% in the warp direction but also have a stiff feeling.

As explained above, when the blending ratio of a poly (trimethylene terephthalate) fiber crimped yarn and the course and wale numbers satisfy the requirements of the present invention, a tubular knitted fabric showing a stretchability of 30% or more, more preferably 50% or more in the warp and weft directions is obtained.

Because joint portions such as elbow portions and knee portions of an undergarment are elongated by 30% or more by bending, an undergarment prepared from a tubular knitted fabric showing a stretch ratio of less than 30% in the warp and weft directions cannot follow the bending in the joint portions. The undergarment therefore gives the wearer a confined feeling, and provides a poor comfort to the wearer.

In the present invention, the tubular knitted fabric shows a recovery of preferably 70% or more when elongated by 30% in the warp (course) and weft (wale) directions, more preferably 80% or more. The undergarment showing a recovery of less than 70% shows insufficient shape stability, and tends to lose shape retention after wearing or washing.

In the present invention, the {stretch ratio in the warp (course) direction}/{stretch ratio in the weft (wale) direction} ratio of the tubular knitted fabric is preferably from 0.2 to 1.2, more preferably from 0.4 to 1.2. When the ratio is in the above range, an undergarment prepared therefrom shows excellent adaptability to the body movement and does not give a confined feeling because the balance between the stretchability in the warp direction and that in the weft direction becomes good.

In addition, the stretch ratio and recovery of the tubular knitted fabric is determined by the measurement methods to be described later.

In order to obtain such a tubular knitted fabric as explained above, the following procedure is preferred: the blending ratio of the poly(trimethylene terephthalate) fiber crimped yarn and the course number and wale number satisfy the requirements of the present invention; and the tubular knitted fabric is dyed and finished while no tension is substantially applied thereto in the warp direction during dyeing. For example, the following procedure should be conducted. A piece-like tubular knitted fabric is prepared from a poly(trimethylene terephthalate) fiber crimped yarn and a short fiber using a single circular knitting machine (trade name of SM-8, manufactured by Santony K.K.), and the tubular knitted fabric is dyed with a paddle dyeing machine, followed by finish setting with a tumbler drying machine. One typical example of an undergarment of such a tubular knitted fabric is a fashioned undergarment. Such a fashioned undergarment herein mentioned is one that is obtained by preparing each part forming the undergarment with a circular knitting machine, dyeing and finishing the parts, and sewing these parts.

In the present invention, the knitted fabric shows a stress at 30% elongation in the warp (course) direction of preferably from 0.2 to 4.9 N/cm, more preferably from 0.3 to 3.0 N/cm, still more preferably from 0.5 to 2.0 N/cm. Usually, when an undergarment is to be prepared, the warp (course) direction of the tubular knitted fabric is often used as the warp direction of the undergarment in order to reduce the loss of the tubular knitted fabric and increase the production efficiency. When such an undergarment is worn, the elbow portions, knee portions, and the like portions are stretched and shrunk in the warp direction of the tubular knitted fabric as the wearer bends. However, when the stress at 30% elongation in the warp direction is in the above range, the wearer has no confined feeling and a suitable fitting feeling. When the tubular knitted fabric shows a stress at 30% elongation of less than 0.2 N/cm, an undergarment prepared therefrom gives an insufficient fitting feeling. Moreover, when the tubular knitted fabric shows a stress at 30% elongation exceeding 4.9 N/cm, the wearer tends to have a confined feeling. In addition, the stress at 30% elongation of the tubular knitted fabric is determined by the measurement method to be described later.

In the present invention, the ratio of dimensional change of the tubular knitted fabric is preferably 10% or less, more preferably 5% or less in the warp (course) direction thereof after repeating 30% elongation in the warp (course) direction thereof 10,000 times. When the dimensional change is 10% or less after the above repeated elongation, an undergarment prepared therefrom produces no looseness in the elbow and knee portions after being worn over a long period of time. The undergarment therefore does not lose shape retention after wearing, has a good outward appearance, and is excellent in a fitting feeling. In addition, the above ratio of dimensional change after repeated elongation is determined by the measurement method to be described later.

In order to obtain a tubular knitted fabric used for the undergarment of the present invention, for example, a single knitting machine, a double knitting machine, or the like machine is used as the knitting machine. Examples of the texture is a plain knitting, an interlock, a circular rib, a rib, a ponti roma, a double tuck, a quilting knit, a Kanoko (tuck float), a Jacqard, or a reversible texture. The gauge is suitably selected from 16 to 32 G. The tubular knitted fabric may then be prepared. When a poly(trimethylene terephthalate) fiber crimped yarn and another yarn are to be mixed knitted on a knitting machine, a procedure of mixed knitting yarns on a machine suited to the purpose may be selected from procedures such as mentioned below: knitting by alternate feeding; mixed knitting in a proportion suited to the texture; and doubling by a step such as total course plaiting, and knitting.

In particular, for a tubular knitted fabric formed from a poly(trimethylene terephthalate) fiber crimped yarn and at least one fiber selected from a cellulose-based short fiber, an animal short fiber and an acrylic short fiber, mixed knitting has the advantage that the stretchability in the warp direction can be increased in comparison with the use of the composite yarn (double twisted yarn, a covering yarn, and the like) explained above. A method of forming a texture (including whole course plaiting) in which loops of a poly(trimethylene terephthalate) fiber crimped yarn are continued in the warp direction is preferred as the mixed knitting method. For example, alternate feeding of an interlock texture (continuously forming loops in the warp direction), a method of forming the front surface and/or back surface of the double tuck with a poly(trimethylene terephthalate) fiber crimped yarn, and the like method can be mentioned.

In the present invention, there is no specific limitation on dyeing and finishing of the tubular knitted fabric, and roll dyeing, piece dyeing, product dyeing, or the like dyeing can be adopted. For example, for the roll dyeing, the following methods are included: (1) a gray fabric is scoured, dyed and finish set; (2) a gray fabric is scoured, preset, dyed, and finish set; and (3) a gray fabric is preset, scoured, scoured, dyed, and finish set.

Furthermore, because the poly(trimethylene terephthalate) fiber crimped yarn changes its feeling according to heat treatment such as presetting and finish setting, the treatment temperature is preferably from 140 to 180° C., more preferably from 150 to 170° C. In addition, when the treatment temperature becomes 190° C. or more, the feeling tends to become stiff.

A conventional procedure for dyeing a poly(ethylene terephthalate) fiber with a dispersion dye may be adopted as one for dyeing a poly(trimethylene terephthalate) fiber crimped yarn. The dyeing temperature is preferably from 90 to 130° C., and the dyeing time is preferably from 15 to 120 minutes. Because a poly(trimethylene terephthalate) fiber shows excellent color developing properties even when dyed at temperature lower than the dyeing temperature of a poly(ethylene terephthalate) fiber, the poly(trimethylene terephthalate) fiber can be dyed at temperature as low as from 90 to 120° C.

In particular, use of a jet-dyeing machine with which a tension is hardly applied in the warp direction during roll dyeing is preferred because the stretchability in the warp direction of the tubular knitted fabric is improved.

An obermaier, a paddle dyeing machine, a drum dyeing machine, or the like may be used for piece dyeing and product dyeing. Because no tension is substantially applied in the warp direction, the stretch ratio can preferably be increased in the warp direction in comparison with roll dyeing.

Ordinary fiber finishing such as resin finishing, water absorption finishing, antistatic finishing, antibacterial finishing and water repellent finishing can be applied during finish setting as long as the object of the present invention is not impaired. In particular, when the tubular knitted fabric is desired to be finished to have a soft feeling, the fabric is preferably finished with a silicone-based textile softener prepared from alkylpolysiloxane, amino-modified silicone, carboxy-modified silicone, epoxy-modified silicone, or the like.

Examples of the heat treating apparatus that can be used for finish setting include a pin tenter, a clip tenter, a short loop drier, a shrink suffer drier, a drum drier, and a continuous or batch type tumbler.

In finish setting a roll, a continuous tumbler with which a tension in the warp direction is hardly applied or a pin tenter that can adjust dimensions in the warp and weft directions while forcibly feeding in the warp direction is preferred. When the pin tenter is used, the stretchability of the fabric in the warp direction is improved by setting the overfeed ratio in the warp direction at preferably from 10 to 50%, more preferably from 15 to 30%.

In order to set pieces and products, suspension drying in a drying machine, the temperature of which is adjusted to from 40 to 80° C., and drying with a batch type tumbler are particularly preferred because the stretchability of the fabric in the warp direction is increased.

BEST MODE FOR CARRYING OUT THE INVENTION

The present invention will be explained below in more detail by making reference to examples. However, the present invention is in no way restricted thereto.

In addition, the measurement methods, evaluation methods, and the like in the present invention are as explained below.

(1) Intrinsic Viscosity [η] (dl/g)

The intrinsic viscosity is a value determined on the basis of the following definition:

$$[\eta]=\lim_{C\to 0} (\eta_r-1)/C$$

wherein $\eta_r$ is a value obtained by dividing a viscosity of a diluted solution at 35° C. that is derived by dissolving a poly(trimethylene terephthalate) yarn or a poly(ethylene terephthalate) yarn in an o-chlorophenol solvent having a purity of 98% or more by the viscosity of the above solvent that is measured at the same temperature, and C is a polymer concentration in terms of g/100 ml.

In addition, for composite multifilaments for which polymers differing from each other in intrinsic viscosity are used, measurement of the intrinsic viscosity of each polymer forming the filaments is difficult. The two types of polymers are therefore each spun singly under the conditions under which the composite multifilaments have been spun. The intrinsic viscosity determined using each yarn thus obtained is defined as the intrinsic viscosity of the polymer forming the composite multifilaments.

(2) Initial Tensile Resistance

A tensile test is conducted in accordance with the method of testing an initial tensile resistance by JIS L-1013 (method of testing a chemical fiber filaments yarn) by applying an initial load of 0.882 mN/dtex per unit size of the sample. The initial tensile resistance (cN/dtex) is calculated from the stress-elongation curve. The measurement is made ten times, and the average value is obtained.

(3) Stretch Elongation and Stretch Modulus

A measurement is made in accordance with the method of testing stretchability (A method) by JIS L-1090 (method of testing a synthetic fiber filaments bulky textured yarn), and the stretch elongation (%) and stretch modulus (%) are calculated. The measurement is made ten times, and the average values are obtained.

Measurements of the stretch elongation of crimp and the stretch modulus of crimp are made on samples that have been unwound from wound packages and that have then been allowed to stand for 24 hours in an environment at temperature of 20±2° C. and humidity of 65±2%.

Samples for measuring the stretch elongation and stretch modulus after boiling water treatment are prepared by immersing in hot water at 98° C. under no load for 30 minutes, and naturally drying under no load for 24 hours.

(4) Thermal Shrinkage Stress

A thermal stress measurement apparatus (trade name of KE-2, manufactured by Kanebo Engineering Ltd.) is used. A sample 20 cm long is cut out, and both ends are tied to form a loop. The loop is mounted on a measurement apparatus, and the thermal shrinkage stress is measured under the following conditions: an initial load of 0.044 cN/dtex; and a heating rate of 100° C./min. The thermal shrinkage stress at 100° C. is read from the curve of thermal shrinkage stress against temperature thus obtained.

(5) Strength and Elongation Characteristics

The tensile strength (cN/dtex), tensile elongation (%) and initial elastic modulus (cN/dtex) of a sample 20 cm long are measured at a tensile rate of 20 cm/min, using a Tensilon (manufactured by Toyo Baldwin K.K.). Moreover, the elongation (%) under a stress of 0.8826 cN/dtex is measured from the stress-elongation curve.

(6) Crimp Elongation

A fiber sample is treated for 15 minutes at a dry heat temperature of 90° C. with an oven (trade name of Perfect Oven, manufactured by Tabai Corp.) while a load of $2.6\times 10^{-4}$ cN/dtex is being applied thereto. The sample is then allowed to stand for a whole day and night, and the crimp elongation is measured in accordance with JIS L-1090 (method of testing stretchability: A method).

(7) Elastic Recovery

A fiber sample is attached to a tensile testing machine (trade name of Tensilon) while an initial load of 0.0294 cN/dtex is being applied with a chuck-to-chuck distance set at 20 cm. The sample is then elongated at a tensile rate of 20 cm/min until the elongation reaches 20%, and is allowed to stand for 1 minute. The sample is subsequently shrunk at the same rate to give a stress-elongation curve. The elastic recovery is obtained from the following formula:

$$\text{elastic recovery } (\%)=\{(20-A)/20\}\times 100$$

wherein A is an elongation (residual elongation) shown by the sample when the stress becomes zero during shrinkage.

(8) Stretch Ratio of Tubular Knitted Fabric

The stretch ratio of a sample is measured in the warp and the weft direction by the grab method in accordance with the method of testing an elongation under a constant load by JIS L-1018. The load applied to the sample is 12.25 N per 2.5 cm of the width of the sample.

(9) Recovery of Tubular Knitted Fabric

The recovery is measured in accordance with A Method (constant elongation) of JIS L-1018 (elongation modulus).

A constant speed-operated tensile testing machine with an automatic recorder is used. An initial load of 2.942 cN is applied to a test piece, 10 cm (width)×15 cm (length). The test piece is then elongated with a grip width of 2.5 cm and a grip-to-grip distance of 10 cm at a rate of 10 cm/min until the elongation reaches 30%, and allowed to stand for 1 minute.

The test piece is subsequently shrunk at the same rate to give a stress-strain curve. The recovery (%) is obtained from the following formula:

$$\text{recovery } (\%)=\{(30-L)/30\}\times 100$$

wherein L (mm) is a residual elongation shown by the test piece when the stress becomes equal to the initial load in the shrinking step.

(10) Durability of Tubular Knitted Fabric

A tubular knitted fabric is repeatedly treated 10 times in accordance with A method by JIS L-0888. The number of yarn breakage in an area, 10 cm×10 cm, of the knitted fabric is measured, and ranked according to the following criteria:

○: no yarn breakage;

Δ: one or less of yarn breakage; and

X: two or more yarn breakages.

(11) Stress at 30% Elongation in Warp Direction of Tubular Knitted Fabric

The stress in the warp direction of a knitted fabric is measured by the grab method in accordance with JIS L-1018 (elongation force at constant elongation). In addition, the elongation is set at 30%.

(12) Dimensional Stability of Tubular Knitted Fabric

A tubular knitted fabric sample on which two marks are put in the warp direction at an interval of 20 cm is attached to a de Mattia fatigue testing machine (manufactured by Daiei Kagaku Seiki K.K.). The machine is adjusted so that the sample is elongated by 30% in the warp direction, and the sample is repeatedly stretched 10,000 times at a rotational rate of 100 rpm. When the stretching test is finished, the interval (in terms of cm) between the two marks is immediately measured, and the ratio of dimensional change is calculated from the following formula:

$$\text{ratio of dimensional change (\%)}=[\{(\text{interval between two marks subsequent to stretching})/20\}-1]\times 100$$

The ratio is used as an index of the dimensional stability.

The ratio of dimensional change is evaluated from the value thus obtained according to the following ranks:

○: the ratio of dimensional change is 5% or less;

Δ: the ratio of dimensional change is from greater than 5% to 10% or less; and

X: the ratio of dimensional change exceeds 10%.

(13) Evaluation of Wearing Undergarments

Five panelists (men aged from twenties to thirties) each wear an undergarment for about four months (from December to March the next year). The undergarments are washed with a household washing machine. Each panelist evaluates after the wearing test the softness, adaptability to the body movement, fitting feeling, tight feeling, shape retention (including a dimensional change caused by washing), bulge feeling and heat retention according to five grades (a first to a fifth grade). Evaluated values of each item given by the panelists are averaged. A larger averaged numerical value indicates that the quality is evaluated to be more excellent.

EXAMPLE 1

A poly(trimethylene terephthalate) showing that $\eta_{sp}/c=0.8$ was spun at 265° C. at a spinning rate of 1,200 m/min to give an undrawn yarn. The undrawn yarn was drawn and twisted at a hot roll temperature of 60° C., hot plate temperature of 140° C., a draw ratio of 3 and a draw rate of 800 m/min to give a drawn yarn of 110 dtex/24 f. The drawn yarn showed a strength of 3.2 cN/dtex, an elongation of 44%, an elastic modulus of 24 cN/dtex and an elastic recovery at 20% elongation of 88%.

The drawn yarn thus obtained was false twisted (one heater false twisting) with a false twisting machine (trade name of IVF-338, manufactured by Ishikawa Seisakusho, Ltd.) at a false twisting number of 2,900 T/m, a texturing rate of 150 m/min, a first feed ratio of −1.5%, a first heater temperature of 165° C., a second heater temperature of room temperature and a second feed ratio of +1.6% to give a crimped yarn. The crimped yarn thus obtained showed a crimp elongation of 184%.

A gray fabric for a tubular knitted fabric (2×2 ribs) was prepared from the crimped yarn thus obtained using a double circular knitting machine (trade name of FRS-L, manufactured by Fukuhara Seiki Seisakusho K.K., 20 gauges, 53.3 cm (212.54 cm) in diameter, a number of needles of 1,320 per bed) that was adjusted so that the course number and wale number of the gray fabric became 28 courses/2.54 cm and 30 wales/2.54 cm, respectively.

The gray fabric thus obtained for the tubular knitted fabric was scoured with a scouring agent at 90° C. for 30 minutes using a jet dyeing machine, washed with water, dyed with a dispersion dye at 120° C. for 20 minutes, and heat treated at 170° C. for 1 minute at an overfeed ratio of 25% in the warp direction of a pin tenter to give a tubular knitted fabric. Table 2 shows the physical properties of the tubular knitted fabric thus obtained.

Next, the tubular knitted fabric obtained by processing as explained above is cut with a band knife to give a knitted fabric for one undergarment. A half sleeve round-neck undergarment (shirt) was prepared by the following procedure: two-needle overlock stitching in the shoulder part sewing; one-needle overlock stitching in the hemming bottoms; two flat needle stitching in the neck line binder; and overlock stitching in the sleeve sewing. Table 3 shows the results of evaluation of wearing the undergarment.

The results of evaluation of wearing the undergarment are as follows. The undergarment had excellent softness and excellent adaptability to the body movement, gave an excellent fitting feeling and no tight feeling, showed shape retention after wearing, and was excellent in durability and dimensional stability.

EXAMPLE 2

A gray fabric for a tubular knitted fabric (2×2 ribs) was prepared from the poly(trimethylene terephthalate) fiber crimped yarn of 110 dtex/24 f obtained in Example 1 and a cotton fiber with a cotton count of 30 (England type cotton count) in a proportion of 1:1 (continuously forming loops in the warp direction) using a double circular knitting machine (trade name of FRS-L, manufactured by Fukuhara Seiki Seisakusho K.K., 20 gauges, 53.3 cm (212.54 cm) in diameter, a number of needles of 1,320 per bed) that was adjusted so that the course number and wale number of the gray fabric became 38 courses/2.54 cm and 32 wales/2.54 cm, respectively.

The gray fabric thus obtained for the tubular knitted fabric was bleached with a scouring agent and hydrogen peroxide at 90° C. for 30 minutes using a jet dyeing machine. The pH was adjusted, and the bleached fabric was washed with water. Of fibers forming the gray fabric for the tubular knitted fabric, the poly(trimethylene terephthalate) fiber was dyed with a dispersion dye at 120° C. for 30 minutes, and washed with water. The cotton fiber was then dyed with a direct dye at 90° C. for 30 minutes, and the fabric was washed with water. The fabric was then heat treated at 170° C. for 1 minute at an overfeed ratio of 20% in the warp direction of a pin tenter to give a tubular knitted fabric. Table 2 shows the physical properties of the tubular knitted fabric thus obtained.

A half sleeve round-neck undergarment was prepared from the tubular knitted fabric thus obtained in the same manner as in Example 1. Table 3 shows the results of evaluation of wearing the undergarment.

The results of evaluation of wearing the undergarment are as follows. The undergarment had excellent softness and excellent adaptability to the body movement, gave an excellent fitting feeling and no tight feeling, showed shape retention after wearing, and was excellent in heat retention, durability and dimensional stability.

EXAMPLE 3

A poly(trimethylene terephthalate) was spun in the same manner as in Example 1 to give a drawn yarn of 84 dtex/36 f. The drawn yarn showed a strength of 3.5 cN/dtex, an elongation of 45%, an elastic modulus of 26 cN/dtex and an elastic recovery at 20% elongation of 87%.

The drawn yarn thus obtained was false twisted (two heater false twisting) with a false twisting machine (trade name of IVF-338, manufactured by Ishikawa Seisakusho, Ltd.) at a false twisting number of 3,400 T/m, a texturing rate of 150 m/min, a first feed ratio of −1.5%, a first heater temperature of 165° C., a second heater temperature of 210° C. and a second feed ratio of +17% to give a crimped yarn. The crimped yarn thus obtained showed a crimp elongation of 22%.

A gray fabric of an interlock tubular knitted fabric in which continuous loops of the poly(trimethylene terephthalate) fiber crimped yarn were formed in the warp direction was prepared from the crimped yarn thus obtained and a cotton fiber with a cotton count of 38 (England type cotton count) in a proportion of 1:1 using a double circular knitting machine (trade name of FRS-L, manufactured by Fukuhara Seiki Seisakusho K.K., 20 gauges, 45.7 cm (182.54 cm) in diameter, a number of needles of 1,130 per bed) that was adjusted so that the course number and wale number of the gray fabric became 37 courses/2.54 cm and 34 wales/2.54 cm, respectively.

The gray fabric for the tubular knitted fabric thus obtained was dyed and finished in the same manner as in Example 2 to give a tubular knitted fabric. An undergarment was prepared from the tubular knitted fabric in the same manner as in Example 1. Table 2 shows the physical properties of the tubular knitted fabric thus obtained, and Table 3 shows the results of evaluation of wearing the undergarment.

The results of evaluation of wearing the undergarment are as follows. The undergarment had excellent softness, excellent adaptability to the body movement, gave an excellent fitting feeling and no tight feeling, showed an excellent bulge feeling and shape retention after wearing, and was excellent in heat retention, durability and dimensional stability.

EXAMPLE 4

A poly(trimethylene terephthalate) was spun in the same manner as in Example 1 to give a drawn yarn of 56 dtex/24 f. The drawn yarn showed a strength of 3.1 cN/dtex, an elongation of 47%, an elastic modulus of 25 cN/dtex and an elastic recovery at 20% elongation of 89%.

The drawn yarn thus obtained and a cuprammonium multifilaments raw yarn of 56 dtex/45 f (trade name of Bemberg, manufactured by Asahi Kasei Corp.) in a proportion of 1:1 were air mingled by interlacing (one heater composite simultaneous false twisting) with a pin false twisting machine (trade name of IVF-338, manufactured by Ishikawa Seisakusho, Ltd.) at a spindle rotation rate of 435,000 rpm, a false twisting number of 2,900 T/m, a texturing rate of 150 m/min, a first feed ratio of −1.5%, a first heater temperature of 165° C., a second feed ratio of +1.6% and an air pressure of 1.2 kgf/cm$^2$ to give a composite crimped yarn. The composite crimped yarn thus obtained showed a crimp elongation of 10%.

A gray fabric knitted in plain knitting for a piece-like tubular knitted fabric was prepared from the composite crimped yarn thus obtained using a single circular knitting machine (trade name of SM-8, manufactured by Santony K.K., 28 gauges, 33.0 cm (132.54 cm) in diameter, a number of needles of 1,152) that was adjusted so that the course number and wale number of the gray fabric became 32 courses/2.54 cm and 36 wales/2.54 cm, respectively.

The gray fabric for the tubular knitted fabric thus obtained was dyed in the same manner as in Example 1 except that a paddle dyeing machine was used in place of the jet dyeing machine and that a tumbler drying machine was used in place of the pin tenter to give a tubular knitted fabric. An undergarment was prepared from the tubular knitted fabric in the same manner as in Example 1. Table 2 shows the physical properties of the tubular knitted fabric thus obtained, and Table 3 shows the results of evaluation of wearing the undergarment.

The results of evaluation of wearing the undergarment are as follows. The undergarment had excellent softness and excellent adaptability to the body movement, gave an excellent fitting feeling and no tight feeling, showed shape retention after wearing, and was excellent in durability and dimensional stability. However, it showed a slightly poor bulge feeling and heat retention.

EXAMPLE 5

A tubular knitted fabric was obtained in the same manner as in Example 2 except for the following procedures: a wool fiber having a wool count of 50 (wool count) was used in place of a cotton fiber having a cotton count of 30; a poly(trimethylene terephthalate) fiber was dyed at 98° C. for 30 minutes; and the wool was dyed at 98° C. for 30 minutes with a chrome dye. Table 2 shows the physical properties of the tubular knitted fabric thus obtained.

An undergarment was prepared from the tubular knitted fabric in the same manner as in Example 1. Table 3 shows the results of evaluation of wearing the undergarment.

The results of evaluation of wearing the undergarment are as follows. The undergarment had excellent softness, excellent adaptability to the body movement and an excellent bulge feeling, gave an excellent fitting feeling and no tight feeling, showed shape retention after wearing, and was excellent in heat retention, durability and dimensional stability.

EXAMPLE 6

A tubular knitted fabric was obtained in the same manner as in Example 2 except for the following procedures: a spun yarn (trade name of Cashmilon, manufactured by Asahi Kasei Corp., 1.4 dtex, fiber length of 51 mm) of an acrylic fiber having a count number of 50 (wool count) was used in place of the cotton fiber having a cotton count of 30; the poly(trimethylene terephthalate) fiber was dyed at 98° C. for 30 minutes; and Cashmilon was dyed with a cationic dye at 98° C. for 30 minutes. Table 2 shows the physical properties of the tubular knitted fabric thus obtained.

An undergarment was prepared from the tubular knitted fabric in the same manner as in Example 1. Table 3 shows the results of evaluation of wearing the undergarment thus obtained.

The results of evaluation of wearing the undergarment are as follows. The undergarment had excellent softness, excellent adaptability to the body movement and an excellent bulge feeling, gave an excellent fitting feeling and no tight feeling, showed shape retention after wearing, and was excellent in heat retention, durability and dimensional stability.

EXAMPLE 7

The poly(trimethylene terephthalate) drawn yarn of 56 dtex/24 f obtained in Example 4 was false twisted (one heater false twisting) with a false twisting machine (trade name of IVF-338, manufactured by Ishikawa Seisakusho, Ltd.) at a false twisting number of 3,780 T/m, a texturing rate of 150 m/min, a first feed ratio of 0.0%, a first heater temperature of 165° C., a second heater temperature of room temperature and a second feed ratio of +1.6% to give a crimped yarn. The crimped yarn thus obtained showed a crimp elongation of 205%.

A gray fabric of a piece-like tubular knitted fabric knitted in plain knitting was prepared from the crimped yarn obtained above and used on the back side and a cotton fiber having a cotton count of 100 (England type cotton count) used on the front side in a proportion of 1:1 using a single circular knitting machine (trade name of SM-8, manufactured by Santony K.K., 28 gauges, 33.0 cm (132.54 cm) in diameter, a number of needles of 1,152) that was adjusted so that the course number and wale number of the gray fabric became 32 courses/2.54 cm and 36 wales/2.54 cm, respectively The gray fabric for the tubular knitted fabric thus obtained was dyed in the same manner as in Example 4 to give a tubular knitted fabric. An undergarment was prepared from the tubular knitted fabric in the same manner as in Example 1.

Table 2 shows the physical properties of the tubular knitted fabric thus obtained, and Table 3 shows the results of evaluation of wearing the undergarment.

The results of evaluation of wearing the undergarment are as follows. The undergarment had excellent softness, excellent adaptability to the body movement and an excellent bulge feeling, gave an excellent fitting feeling and no tight feeling, and was excellent in heat retention, durability and dimensional stability.

EXAMPLE 8

Two types of poly(trimethylene terephthalate) differing from each other in intrinsic viscosity was extruded in a ratio of 1:1 in a side-by-side manner at a spinning temperature of 265° C. at a spinning rate of 1,500 m/min to give an undrawn yarn. The undrawn yarn was then drawn and twisted at a hot roll temperature of 55° C., a hot plate temperature of 140° C. and a drawing rate of 400 m/min while the drawing ratio was set so that the size became 84 dtex to give a side-by-side type multifilaments raw yarn of 84 dtex/12 f. The raw yarn thus obtained had the following intrinsic viscosity: $[\eta]=0.88$ on the high viscosity side; and $[\eta]=0.70$ on the low viscosity side.

A tubular knitted fabric was obtained in the same manner as in Example 2 except that the side-by-side type composite multifilaments raw yarn thus obtained was used in place of the poly(trimethylene terephthalate) fiber crimped yarn. Table 2 shows the physical properties of the tubular knitted fabric thus obtained.

An undergarment was prepared from the tubular knitted fabric thus obtained in the same manner as in Example 1. Table 3 shows the results of evaluation of wearing the undergarment.

The results of evaluation of wearing the undergarment are as follows. The undergarment had excellent softness, excellent adaptability to the body movement and an excellent bulge feeling, gave an excellent fitting feeling and no tight feeling, showed shape retention after wearing, and was excellent in heat retention, durability and dimensional stability.

EXAMPLE 9

A tubular knitted fabric was obtained in the same manner as in Example 2 except that a poly(trimethylene terephthalate) fiber crimped yarn of 56 dtex/24 f obtained in Example 7 was used in place of the poly(trimethylene terephthalate) fiber crimped yarn of 110 dtex/48 f and that a cotton fiber having a cotton count of 24 was used in place of the cotton fiber having a cotton count of 30. Table 2 shows the physical properties of the tubular knitted fabric thus obtained.

An undergarment was prepared from the tubular knitted fabric in the same manner as in Example 1. Table 3 shows the results of evaluation of wearing the undergarment thus obtained.

The results of evaluation of wearing the undergarment are as follows. The undergarment had excellent softness, excellent adaptability to the body movement and an excellent bulge feeling, gave an excellent fitting feeling and no tight feeling, showed shape retention after wearing, and was excellent in heat retention, durability and dimensional stability

Comparative Example 1

A tubular knitted fabric was obtained in the same manner as in Example 2 except that the course number and wale number of the gray fabric were set at 10 courses/2.54 cm and 23 wales/2.54 cm, respectively. Table 2 shows the physical properties of the tubular knitted fabric thus obtained.

An undergarment was prepared from the tubular knitted fabric in the same manner as in Example 1. Table 3 shows the results of evaluation of wearing the undergarment.

The results of evaluation of wearing the undergarment were as follows. The undergarment compared with that in Example 2 had poor adaptability to the body movement, gave a poor fitting feeling, and showed significantly deteriorated shape retention after wearing, poor dimensional stability, inferior heat retention and a poor bulge feeling.

Comparative Example 2

A tubular knitted fabric was obtained in the same manner as in Example 2 except that the course number and wale number of the gray fabric were set at 63 courses/2.54 cm and 53 wales/2.54 cm, respectively. Table 2 shows the physical properties of the tubular knitted fabric thus obtained.

An undergarment was prepared from the tubular knitted fabric in the same manner as in Example 1. Table 3 shows the results of evaluation of wearing the undergarment.

The results of evaluation of wearing the undergarment were as follows. The undergarment compared with that in Example 2 had poor softness and inferior adaptability to the body movement, gave a poor fitting feeling and a very tight feeling, and showed poor dimensional stability.

Comparative Example 3

A poly(ethylene terephthalate) fiber (manufactured by Asahi Kasei Corp.) was false twisted (one heater false twisting) with a false twisting machine (trade name of IVF-338, manufactured by Ishikawa Seisakusho, Ltd.) at a spindle rotation rate of 513,000 rpm, a false twisting number of 2,700 T/m, a texturing rate of 190 m/min, a first feed ratio of 1%, a first heater temperature of 210° C., a second heater temperature of room temperature and a second feed ratio of +1.6% to give a poly(ethylene terephthalate) fiber crimped yarn. The crimped yarn thus obtained showed a crimp elongation of 145%.

A tubular knitted fabric was obtained in the same manner as in Example 2 except that the poly(ethylene terephthalate) fiber crimped yarn thus obtained was used in place of the poly(trimethylene terephthalate) fiber crimped yarn of 110 dtex/24 f. Table 2 shows the physical properties of the tubular knitted fabric thus obtained.

An undergarment was prepared from the tubular knitted fabric in the same manner as in Example 1. Table 3 shows the results of evaluation of wearing the undergarment.

The results of evaluation of wearing the undergarment were as follows. The undergarment compared with that in Example 2 had poor softness and inferior adaptability to the body movement, gave a poor fitting feeling and a tight feeling, and showed easily lost shape retention after wearing and poor dimensional stability.

Comparative Example 4

A tubular knitted fabric was obtained in the same manner as in Example 1 except that a cotton fiber having a cotton count of 40 was used in place of the poly(trimethylene terephthalate) fiber crimped yarn of 110 dtex/24 f, that a direct dye was used and that the dyeing temperature was changed to 90° C. Table 2 shows the physical properties of the tubular knitted fabric thus obtained.

An undergarment was prepared from the tubular knitted fabric in the same manner as in Example 1. Table 3 shows the results of evaluation of wearing the undergarment.

The results of evaluation of wearing the undergarment were as follows. The undergarment compared with those in Examples 1 to 2 had poor flexibility and inferior adaptability to the body movement, gave a poor fitting feeling, and showed easily lost shape retention after wearing and poor dimensional stability.

Comparative Example 5

A tubular knitted fabric was obtained in the same manner as in Example 2 except that a covering yarn was used in place of the poly(trimethylene terephthalate) fiber crimped yarn of 110 dtex/24 f. The covering yarn was prepared from spandex of 44 dtex (trade name of Roica, manufactured by Asahi Kasei Corp.) as a core yarn which was double covered (draft ratio of spandex of 200%) with 66 nylon FTY of 56 dtex/17 f (trade name of Leona, manufactured by Asahi Kasei Corp.). Table 2 shows the physical properties of the tubular knitted fabric thus obtained.

An undergarment was prepared from the tubular knitted fabric in the same manner as in Example 1. Table 3 shows the results of evaluation of wearing the undergarment.

As a result of evaluation of wearing the undergarment, it showed poor durability in comparison with that in Example 2.

Comparative Example 6

A side-by-side type composite multifilaments raw yarn of 56 dtex/12 f was obtained from two types of poly(ethylene terephthalate) differing from each other in intrinsic viscosity. The raw yarn thus obtained had the following intrinsic viscosity: $[\eta]=0.66$ on the high viscosity side; and $[\eta]=0.50$ on the low viscosity side. Table 1 shows the physical properties of the raw yarn thus obtained.

A tubular knitted fabric was obtained in the same manner as in Example 8 except that the thus obtained side-by-side type composite multifilaments raw yarn formed from a poly(ethylene terephthalate) was used in place of the side-by-side type composite multifilaments raw yarn of 84 dtex/12 f formed from the poly(trimethylene terephthalate) in two components. Table 2 shows the physical properties of the tubular knitted fabric thus obtained.

An undergarment was prepared from the tubular knitted fabric thus obtained in the same manner as in Example 1. Table 3 shows the results of evaluation of wearing the undergarment.

The results of evaluation of wearing the undergarment were as follows. The undergarment compared with that in Example 8 had poor softness, poor adaptability to the body movement, gave a poor fitting feeling and a tight feeling, and showed easily losable shape retention after wearing and poor dimensional stability.

Comparative Example 7

A tubular knitted fabric was prepared in the same manner as in Example 2 except that a double circular knitting machine of 12 GG was used in place of 20 gauges and that the course number and wale number were adjusted to 15 courses/2.54 cm and 17 wales/2.54 cm, respectively. Table 2 shows the physical properties of the tubular knitted fabric thus obtained.

An undergarment was prepared from the tubular knitted fabric thus obtained in the same manner as in Example 1. Table 3 shows the results of evaluation of wearing the undergarment.

The results of evaluation of wearing the undergarment were as follows. The undergarment compared with that in Example 2 had poor adaptability to the body movement and a poor bulge feel, gave a poor fitting feeling, and showed poor durability, easily lost shape retention after wearing and poor heat retention.

TABLE 1

| | Example 8 | Comp. Example 6 |
|---|---|---|
| Type of polymer | PTT/PTT | PET/PET |
| Size (dtex)/number of filaments (f) | 84/12 | 56/12 |
| Initial tensile resistance (cN/dtex) | 25 | 71 |
| Stretch elongation of crimp (%) | 24 | 1 |
| Stretch modulus of crimp (%) | 90 | 100 |
| Stretch elongation of crimp after boiling water treatment (%) | 246 | 70 |
| Stretch modulus of crimp after boiling water treatment (%) | 99 | 95 |
| Thermal shrinkage stress (cN/dtex) | 0.17 | 0.08 |
| Strength (cN/dtex) | 2.6 | 2.7 |
| Elongation (%) | 32 | 23 |
| Elastic recovery at 20% elongation (%) | 82 | 25 |

TABLE 2

| | Blending ratio of PTT crimped yarn (wt. %) | Course number | Wale number | C/W* ratio | Stretch ratio (%) Warp | Stretch ratio (%) Weft | Recovery % Warp | Recovery % Weft | Ratio of stretch ratio (warp/weft) | Stress at 30% elongation | Durability | Dimensional stability |
|---|---|---|---|---|---|---|---|---|---|---|---|---|
| Ex. 1 | 100 | 45 | 49 | 0.91 | 100 | 140 | 90 | 88 | 0.7 | 0.6 | ○ | ○ |
| Ex. 2 | 36 | 52 | 42 | 1.23 | 66 | 168 | 82 | 82 | 0.4 | 1.2 | ○ | ○ |
| Ex. 3 | 34 | 49 | 48 | 1.02 | 56 | 183 | 88 | 89 | 0.3 | 1.6 | ○ | ○ |
| Ex. 4 | 50 | 38 | 42 | 0.90 | 140 | 154 | 88 | 86 | 0.9 | 0.4 | ○ | ○ |
| Ex. 5 | 36 | 51 | 44 | 1.15 | 68 | 170 | 83 | 84 | 0.4 | 1.2 | ○ | ○ |
| Ex. 6 | 36 | 50 | 43 | 1.16 | 65 | 165 | 81 | 83 | 0.4 | 1.3 | ○ | ○ |
| Ex. 7 | 49 | 42 | 45 | 0.93 | 165 | 150 | 83 | 84 | 1.1 | 0.3 | ○ | ○ |
| Ex. 8 | 36 | 53 | 47 | 1.13 | 87 | 174 | 89 | 91 | 0.5 | 0.8 | ○ | ○ |

TABLE 2-continued

| | Blending ratio of PTT crimped yarn (wt. %) | Course number | Wale number | C/W* ratio | Stretch ratio (%) Warp | Stretch ratio (%) Weft | Recovery % Warp | Recovery % Weft | Ratio of stretch ratio (warp/weft) | Stress at 30% elongation | Durability | Dimensional stability |
|---|---|---|---|---|---|---|---|---|---|---|---|---|
| Ex. 9 | 18 | 48 | 41 | 1.17 | 50 | 138 | 82 | 80 | 0.4 | 1.9 | ○ | ○ |
| CE. 1 | 36 | 13 | 28 | 0.46 | 120 | 200 | 68 | 67 | 0.6 | 0.5 | ○ | ○ |
| CE. 2 | 36 | 83 | 75 | 1.11 | 27 | 27 | 72 | 78 | 1.0 | 6.2 | ○ | X |
| CE. 3 | 0 | 51 | 32 | 1.59 | 26 | 90 | 65 | 67 | 0.3 | 6.8 | ○ | Δ |
| CE. 4 | 0 | 50 | 33 | 1.51 | 25 | 124 | 58 | 65 | 0.2 | 7.8 | ○ | X |
| CE. 5 | 0 | 55 | 48 | 1.15 | 120 | 100 | 88 | 90 | 1.2 | 1.3 | X | ○ |
| CE. 6 | 0 | 48 | 50 | 0.96 | 57 | 177 | 66 | 68 | 0.3 | 1.8 | ○ | X |
| CE. 7 | 36 | 14 | 19 | 0.74 | 280 | 300 | 40 | 32 | 0.9 | 0.1 | ○ | X |

Note:
*C/W = Courses/Wales

TABLE 3

| | Evaluation of wearing undergarment | | | | | | |
|---|---|---|---|---|---|---|---|
| | Softness | Adaptability to body movement | fitting feeling | Tight feeling | Shape retention | Bulge feeling | Heat retention |
| Ex. 1 | 4.2 | 4.5 | 4.3 | 4.2 | 4.8 | 3.8 | 3.7 |
| Ex. 2 | 4.3 | 4.0 | 4.4 | 4.1 | 4.2 | 4.2 | 4.2 |
| Ex. 3 | 3.8 | 3.8 | 4.2 | 4.0 | 4.0 | 4.2 | 4.2 |
| Ex. 4 | 4.4 | 4.6 | 4.4 | 4.5 | 4.2 | 2.8 | 3.6 |
| Ex. 5 | 4.6 | 4.2 | 4.3 | 4.2 | 4.1 | 4.4 | 4.6 |
| Ex. 6 | 4.2 | 4.0 | 4.5 | 4.2 | 4.3 | 4.3 | 4.5 |
| Ex. 7 | 4.6 | 4.9 | 4.8 | 4.8 | 4.6 | 4.8 | 4.8 |
| Ex. 8 | 4.0 | 4.5 | 4.6 | 4.7 | 4.7 | 4.4 | 4.4 |
| Ex. 9 | 4.2 | 3.7 | 4.1 | 4.0 | 4.1 | 4.0 | 4.1 |
| CE. 1 | 4.5 | 1.5 | 1.5 | 4.6 | 1.3 | 2.8 | 1.4 |
| CE. 2 | 1.2 | 1.4 | 2.8 | 2.3 | 4.6 | 3.6 | 4.4 |
| CE. 3 | 2.8 | 2.7 | 2.2 | 2.4 | 3.2 | 3.5 | 4.1 |
| CE. 4 | 3.2 | 2.6 | 1.3 | 1.1 | 3.0 | 3.6 | 4.0 |
| CE. 5 | 3.4 | 4.4 | 4.6 | 3.7 | 3.2 | 3.2 | 4.2 |
| CE. 6 | 2.6 | 2.9 | 2.8 | 2.0 | 3.7 | 3.4 | 4.0 |
| CE. 7 | 4.2 | 1.0 | 1.0 | 4.9 | 1.0 | 2.4 | 1.0 |

Industrial Applicability

The undergarment of the present invention has excellent softness, excellent adaptability to the body movement and an excellent feeling, gave an excellent fitting feeling and no tight feeling, and showed shape retention after wearing, and is excellent in heat retention and/or durability and/or dimensional stability after repeated elongation.

What is claimed is:

1. An undergarment formed from a tubular mixed knitted fabric that comprises a poly(trimethylene terephthalate) fiber crimped yarn and a short fiber, a blending ratio of the crimped yarn is 15 to 60% by weight, a blending ratio of the short fiber is 30 to 85% by weight, and the tubular knitted fabric has a course number of from 30 to 70 courses/2.54 cm and a wale number of from 30 to 70 wales/2.54 cm.

2. The undergarment according to claim 1, wherein the poly(trimethylene terephthalate) fiber crimped yarn is composed of a false-twisted yarn.

3. The undergarment according to claim 1, wherein the poly(trimethylene terephthalate) fiber crimped yarn is a latently crimpable polyester fiber comprising a plurality of polyester components, wherein at least one of the components is a poly(trimethylene terephthalate).

4. The undergarment according to claim 3, wherein the latently crimpable polyester fiber satisfies the following conditions (a) to (c):

(a) an initial tensile resistance of from 10 to 30 c/dtex;

(b) a stretch elongation of crimp of from 10 to 100% and a stretch modulus of crimp of from 80 to 100% after development of latent crimping; and (c) a thermal shrinkage stress at 100° C. of from 0.1 to 0.5 cN/dtex.

5. The undergarment according to any one of claims 1 to 3, wherein the short fiber is at least one fiber selected from the group consisting of a cellulose-based fiber, an acrylic fiber and an animal fiber.

6. The undergarment according to any one of claims 1 to 3, wherein a (course number)/(wale number) ratio of the tubular mixed knitted fabric is from 0.5 to 1.5.

7. The undergarment according to any one of claims 1 to 3, wherein a {stretch ratio in the warp (course) direction}/{stretch ratio in the weft (wale) direction} ratio of the tubular mixed knitted fabric is from 0.2 to 1.2.

8. The undergarment according to any one of claims 1 to 3, wherein a stress at 30% elongation of the tubular mixed knitted fabric is from 0.2 to 4.9 N/cm in the warp (course) direction.

9. The undergarment according to any one of claims 1 to 3, wherein a ratio of dimensional change of the tubular mixed knitted fabric is 10% or less in the warp (course) direction after repeating 30% elongation in the warp (course) direction of the knitted fabric 10,000 times.

* * * * *